United States Patent [19]

Gelin

[11] 3,948,590

[45] Apr. 6, 1976

[54] AXIALLY CENTERING MEANS FOR FLUID MACHINES

[75] Inventor: Robert Gelin, Blaustein, Germany

[73] Assignee: G. L. Rexroth GmbH, Lohr, Main, Germany

[22] Filed: June 14, 1974

[21] Appl. No.: 479,491

[30] Foreign Application Priority Data

June 20, 1973 Germany ..... 2331462

[52] U.S. Cl. ..... 418/81

[51] Int. Cl.[2] ..... F01C 21/16; F04C 15/04

[58] Field of Search ..... 418/81

[56] References Cited

UNITED STATES PATENTS

| | | | |
|---|---|---|---|
| 2,387,761 | 10/1945 | Kendrick | 418/81 X |
| 2,816,511 | 12/1957 | Korkowski | 418/81 |
| 3,516,767 | 6/1970 | Perkins | 418/81 |
| 3,695,789 | 10/1972 | Jansson | 418/81 |
| 3,744,942 | 7/1973 | Mount | 418/81 X |

*Primary Examiner*—C. J. Husar
*Assistant Examiner*—Leonard Smith
*Attorney, Agent, or Firm*—Michael J. Striker

[57] ABSTRACT

A fluid machine, particularly a hydraulic pump, has a high pressure side and a low pressure side. A rotor or a pair of cooperating gears are mounted for rotation and have spaced end faces extending transversely of their respective axes of rotation. Walls define at each of these end faces at least one fluid compartment which is open to the respective end face and which communicates via a restricted outflow gap with the low pressure side of the machine, and via a conduit with the high pressure side of the machine. In each conduit a throttle is interposed, and the end faces are subjected from the respective compartments to fluid pressures which permanently tend to equalize with one another, and which therefore tend to axially center the rotor or gears in the event of axial displacement thereof.

12 Claims, 6 Drawing Figures

AXIALLY CENTERING MEANS FOR FLUID MACHINES

BACKGROUND OF THE INVENTION

The present invention relates generally to a fluid machine, and more particularly to a hydraulic fluid machine. This term includes hydraulic pumps such as vane-type pumps and gear pumps.

In hydraulic fluid machines, such as vane-type pumps or gear pumps, it is desired to be able to axially center the rotor in the case of a vane-type pump, or the gears in the case of a gear-type pump. This is achieved in the prior art by providing at the opposite axial end faces of the rotor or gears respective compartments which are open to these end faces and which are in direct communication with the high pressure side of the pump or, in the case of gear pumps, even with the region where the gears interengage and thus produce pressure in the fluid. The concept behind this arrangement is the assumption that a centering of the gears or rotor in axial direction will be achieved, in that any axial shifting in one direction will cause in that compartment towards which the rotor or gear has shifted, an increase in pressure which will counteract the shifting and return the rotor or gear towards centered position. In actual fact it has, however, been observed that a sufficient pressure increase does not take place and that therefore the desired centering action is not reliably obtainable.

SUMMARY OF THE INVENTION

It is, accordingly, a general object of the invention to overcome the aforementioned disadvantages.

More particularly, it is an object of the present invention to provide a fluid machine of the type in question which affords reliable and automatic axial centering of its rotating element, e.g., its rotor in the case of a vane-type pump or its gears in the case of a gear pump, under all operating conditions.

In keeping with these objects, and with others which will become apparent hereafter, one feature of the invention resides in a fluid machine having a high-pressure side and a low-pressure side, particularly a hydraulic pump, which comprises a rotatable member mounted for rotation about an axis and having spaced end faces extending transversely of this axis. Wall means defines at each of these end faces at least one fluid compartment which is open to the respective end face, passage means connecting the compartment with the high-pressure side, and a restricted outflow gap connecting the compartment with the low-pressure side. A throttle is interposed in each of the passage means; and the end faces are thus subjected to respective fluid pressures which permanently tend to equalize with one another and therefore to axially center the rotatable member in the event of axial displacement thereof.

The provision of the throttles assures that, in conjunction with the variable gaps—which are variable if and as axial shifting of the rotary element occurs—a precisely defined pressure will develop in the pressure compartments. If the gaps are identical at the opposite axial ends of the rotary element, that is if the rotary element is axially centered, then these pressures in the respective compartments will be identical, assuming that the throttles are similarly identical, as will be the case. If the rotary element shifts in one or the other axial direction, then one of the gaps will become larger and the other one will become correspondingly smaller. Due to the presence of the throttles in the passage means, this results in the development of sufficient differential pressures in the compartments at the opposite axial ends of the rotary element to assure that the rotary element is returned to its centered position.

A particularly effective centering action is obtained when the effective cross section of the throttles is the same as or smaller than the effective cross section of the respectively associated gap, whereby the effective cross section of the gap is considered as of the time when the rotary element is axially centered.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
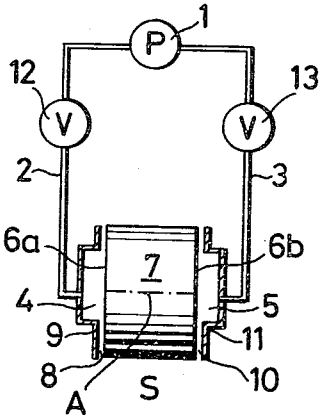
FIG. 1 is a diagrammatic view illustrating the principle on which the present invention is based.

Before referring to the Figures which illustrate the two specific exemplary embodiments, a discussion of the principle behind the present invention will be helpful. FIG. 1 illustrates this principle in diagrammatic form.

Reference numeral 1 in FIG. 1 identifies a source of pressure fluid, and since each hydraulic pump has a high-pressure side and a low-pressure side the source 1 will hereafter be considered to be the high-pressure side. Indeed, ordinarily there will not be a separate source of pressure fluid, but the pressure required for the axial centering of the respective rotary element will be derived from the fluid that is present at the high-pressure side of the respective pump. Reference numerals 2 and 3 identify a pair of passages or conduits which extend from the high-pressure side 1 to respective pressure compartments 4 and 5 which are located at the opposite axial end faces 6*a*, 6*b* of a rotary member 7, e.g., a rotor of a vane-type pump, or a gear or gears of a gear pump. In any case, the rotary member 7 is rotatable about the diagrammatically illustrated axis A.

A housing portion 9 defines with the axial end face 6*a* a gap 8 which communicates with the compartment 4 and also with the suction side or low-pressure side S of the pump. Another housing portion 11 defines with the opposite axial end face 6*b* a similar gap 10 which communicates with the compartment 5 and also with the low-pressure side S.

A fixed throttle 12 is interposed in the passage 2, and a similar throttle 13 is interposed in the passage 3. The gaps 8 and 10 operate, in effect, as variable throttles, since their effective cross section can increase or decrease depending upon axial displacement of the member 7. The effective cross section of the throttles 12, 13 is smaller than the effective cross section of the respectively associated gap 8 or 10, when the latter have the size that is dictated by the member 7 being in axially centered position.

Given the fact that the effective cross sections of the throttles 12 and 13 are identical, and assuming that the effective cross sections of the gaps 8 and 10 are also identical due to the fact that the member 7 is in axially centered position, then the pressure of fluid which acts from the respective compartments 4 and 5, which are of course open to the end faces 6*a* and 6*b*, respectively, upon these end faces is identical and the member 7 is maintained in axially centered position. If, for example as a result of external influences on the member 7 or due to fluctuations in the fluid flow, the member 7 shifts axially, for example towards the housing portion 9, this will result in a decrease of the effective cross section of the gap 8 and a consonant increase of the effective cross section of the gap 10. The result of this will be an increase of pressure in the compartment 4, whereas a concomitant and equal decrease of pressure will occur in the compartment 5, so that a differential pressure develops which acts upon the member 7, shifting the latter axially towards the housing portion 11 until the effective cross sections of the gaps 8 and 10 are again equal.

Figure 3:
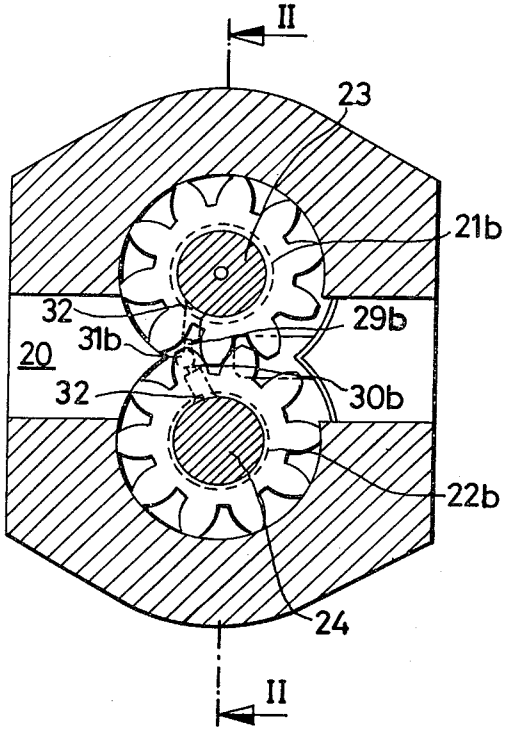
FIG. 3 is a section on line III—III of FIG. 2.
Figure 2:
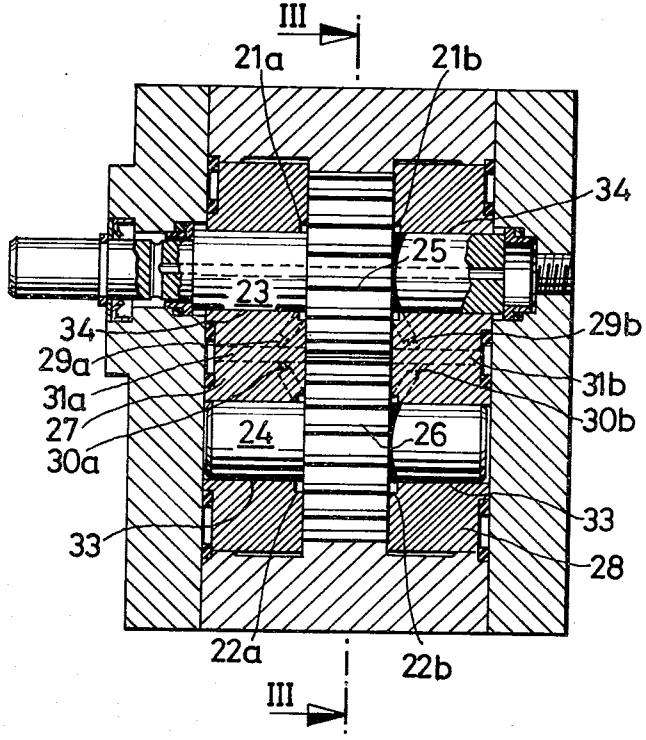
FIG. 2 is a section taken on line II—II of FIG. 3 and illustrating a first embodiment of the invention, embodied in a gear pump.
Figure 4:
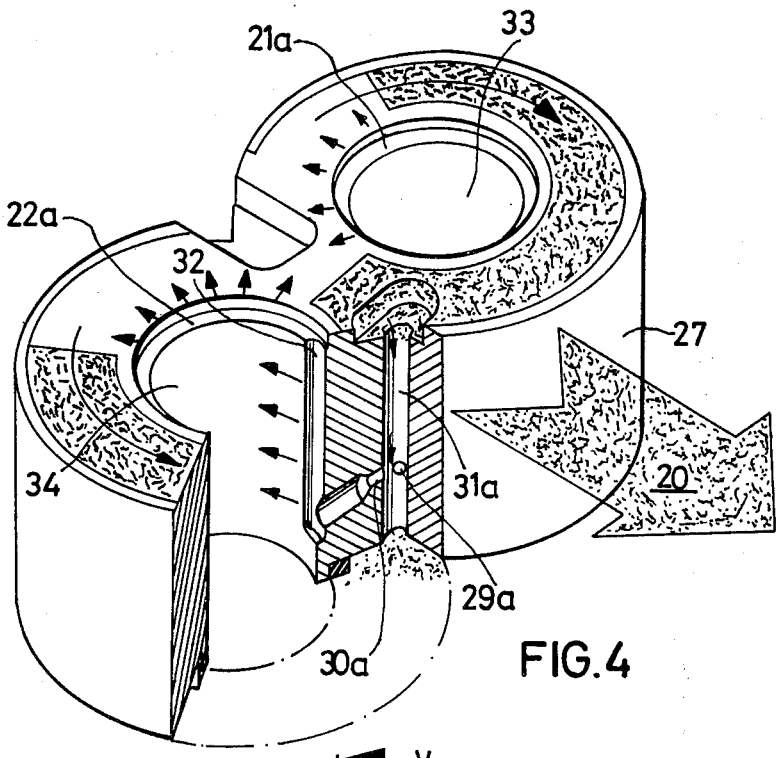
FIG. 4 is a perspective view of an end cover used in the embodiment of FIGS. 2 and 3.

Having thus discussed the principle of the present invention, FIGS. 2–4 may now be considered which illustrate one embodiment of the invention, provided in a gear pump. In FIGS. 2–4 the pressure source, that is the source of pressure fluid which was designated separately with reference numeral 1 in FIG. 1, is constituted by the high-pressure side 20 of the pump. The compartments 4 and 5 of FIG. 1 here have their counterparts formed in cover members 27, 28 of substantially the outline of a figure eight and each located adjacent one axial end of the gears 25 and 26 which are rotatable on shafts 23, 24. The side of the cover member 27 which faces one axial end of the gears 25, 26 is formed with a pair of annular recesses 21*a*, 22*a* which correspond to the compartment 4 of FIG. 1, and the side of the cover member 28 which faces the opposite axial ends of the gears 25, 26 is formed with a pair of annular recesses 21*b*, 22*b* which correspond to the compartment 5 of FIG. 1. These recesses respectively encircle the shafts 23, 24 in the proximity thereof.

The cover members 27, 28 are formed with axial bores 31*a*, 31*b* which communicate with the high-pressure side 20 of the pump. Throttle bores 29*a*, 30*a* extend from the bore 31*a*, and similar throttle bores 29*b*, 30*b* extend from the bore 31*b* and all communicate with a respective axial groove 32 formed in the region of the respective shaft 23, 24; these axial grooves 32 in turn communicate with the respective pressure compartments. The bores 29*a*, 29*b*, 30*a* and 30*b* have the same function as and correspond to the diagrammatically illustrated fixed throttles 12, 13 of FIG. 1.

Due to the fact that the pressure compartments are provided in the immediate vicinity of the shafts 23, 24 and that in fact the shafts 23, 24 themselves form one wall delimiting them, and the supply of the pressure fluid takes place via the grooves 32 which extend over almost the entire length of the journalling bores wherein the shafts 23, 24 are journalled in the cover members 27, 28, the invention obtains the additional advantage of providing not only for the axial centering of the gears but also at the same time for being able to utilize the fluid used for the axial centering to lubricate in a fully adequate manner the journal bores 33, 34.

The operation of the embodiment in FIGS. 2–4, of which in FIG. 4 only the cover member 27 has been illustrated by way of example, is of course the same in principle as that which has been described with respect to FIG. 1.

Figure 6:
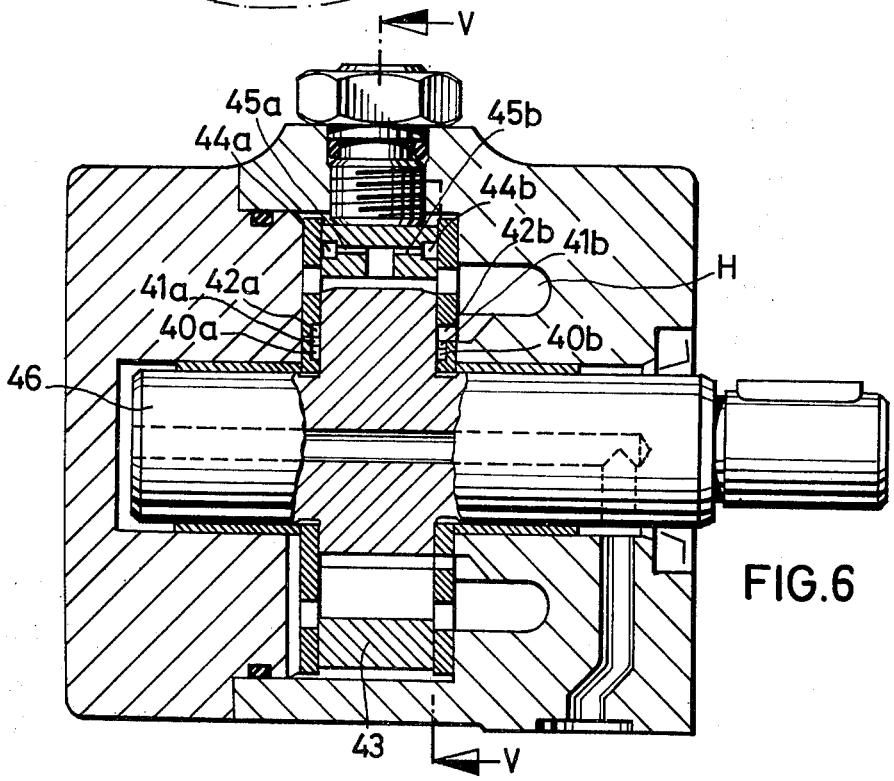
FIG. 6 is a section taken on line VI—VI of FIG. 5.
Figure 5:
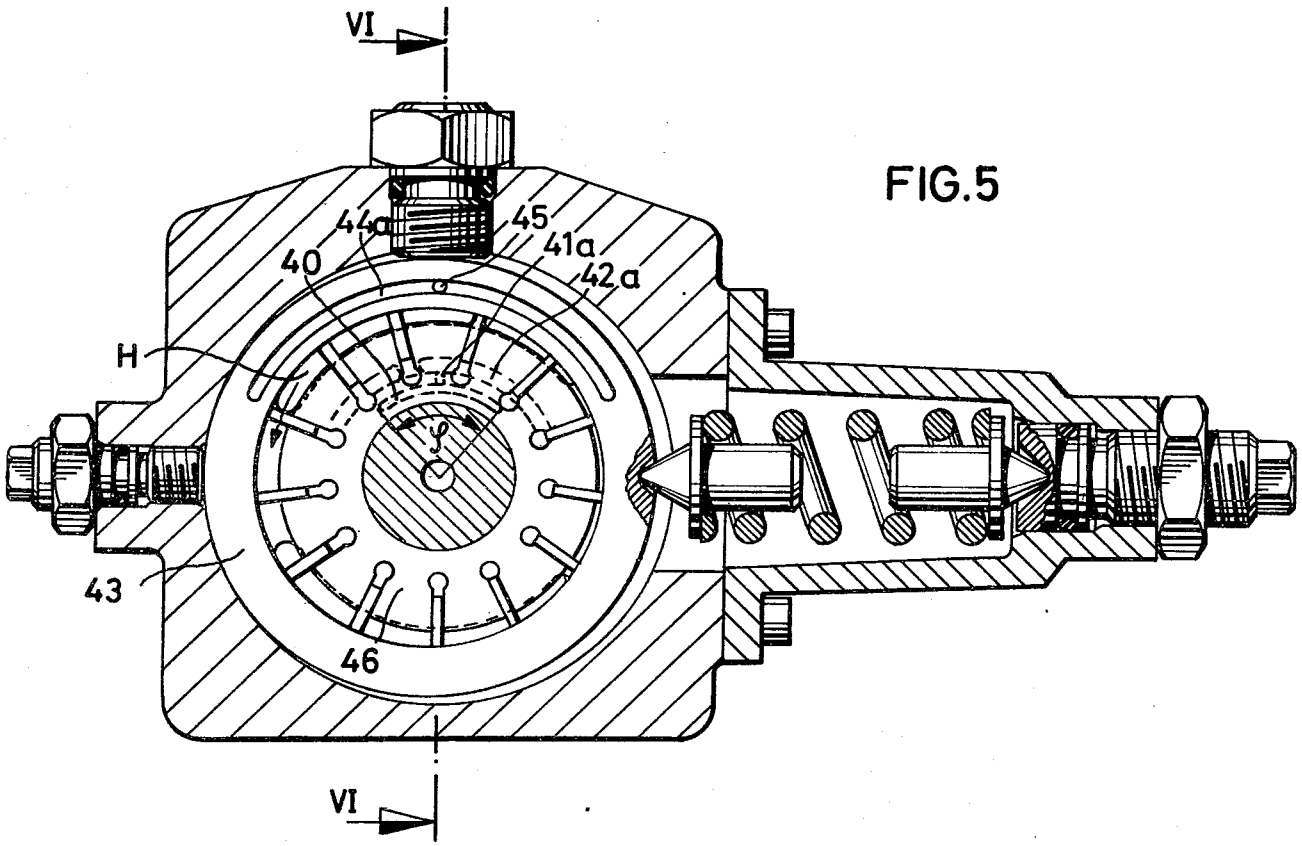
FIG. 5 is a section taken on line V—V of FIG. 6 and showing the invention embodied in a vane-type pump.

Similarly, the operation of the embodiment of FIGS. 5 and 6 is in principle the same as in FIG. 1. Here, the invention has been incorporated in a vane-type pump, and in particular in a sliding vane pump. The pressure compartments corresponding to the compartments 4, 5 of FIG. 1 are here constituted by arcuate grooves 40*a*, 40*b* in valve plates located at opposite axial ends of the rotor 46 which is surrounded by the control ring 43. These grooves 40*a*, 40*b* communicate via respective throttle bores 41*a*, 41*b* (which correspond with the throttles 12, 13 of FIG. 1) with the control slot 42*a*, 42*b* which is in communication with the fluid of the high-pressure side H of the pump. In the illustrated embodiment of FIGS. 5 and 6, the control ring 43 is similarly provided at its opposite axial ends with grooves 44*a*, 44*b* each of which is also provided with a throttle bore 45*a*, 45*b* having the functions of the throttles 12, 13 in FIG. 1 and communicating with the high-pressure side of the pump. This means that in FIGS. 5 and 6 it is not only the rotor 46 which is axially centered by fluid pressure, but also the control ring 43.

It is evident that modifications may be made in the illustrated embodiments without thereby departing from the concept and intent of the invention. For example, in the embodiment of FIGS. 5 and 6, the grooves 40*a*, 40*b* could extend completely circumferentially of the rotor 46, rather than being only arcuate segments. They could also be provided in the end faces of the rotor 46 itself, instead of the end plates which are not shown. In FIGS. 2–4, the compartments could be located further away from the shafts for the gears. In all embodiments, the throttle bores which constitute the equivalence of the fixed throttles 12, 13 could instead be constructed so as not to have a throttling function, and could have separate fixed throttles of conventional design interposed in them.

It will be understood that each of the elements described above, or two or more together, may also find a useful application in other types of constructions differing from the type described above.

While the invention has been illustrated and described as embodied in a fluid machine, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic pump having a high-pressure side and a low-pressure side, comprising a rotatable member mounted for rotation about an axis and having spaced end faces extending transversely of said axis; wall means defining at each of said end faces at least one fluid compartment which is open to the respective end face, passage means connecting said compartment with said high-pressure side, and a restricted outflow gap connecting said compartment with said low-pressure side; and a fixed throttle interposed in each of said passage means, said end faces being subjected to respective fluid pressures which permanently tend to equalize with one another and therefore to axially center said rotatable member in the event of axial displacement thereof, all of the fluid flowing from said high-pressure side of said pump over said restricted outflow gap to said low-pressure side passes through said fixed throttle independent of the axial displacement of said rotatable member.

2. A pump as defined in claim 1, wherein said rotatable member is a rotor of a vane pump.

3. A pump as defined in claim 1, wherein said gaps have an effective cross section when said rotatable member is axially centered; and wherein the effective cross sections of said throttles are smaller than the effective cross sections of said gaps.

4. A pump as defined in claim 1, wherein said gaps have an effective cross section when said rotatable member is axially centered; and wherein the effective cross sections of said throttles are equal to the effective cross sections of said gaps.

5. A pump as defined in claim 1, wherein said compartments are identical with one another, and said throttles are identical with each other.

6. A pump as defined in claim 1, wherein said compartments are constituted by grooves formed in said end faces.

7. A pump as defined in claim 1; further comprising end covers located adjacent the respective end faces and each having a side facing one of said end faces; said compartments being constituted by grooves formed in the respective sides of said end covers and encircling said axis of rotation proximal to the latter.

8. A pump as defined in claim 1, wherein said rotatable member is a gear of a gear pump; and further comprising an additional gear mounted for rotation about an axis parallel to the first-mentioned axis and cooperating with the first-mentioned gear; said wall means defining said compartments also at the end faces of said additional gear.

9. A pump as defined in claim 8, further comprising a pair of shafts, one for each of said gears; and a pair of end covers located adjacent the opposite axial ends of said gears and having covers through which said shafts extend; said compartments being constituted by grooves formed in sides of said end covers which face towards the respective end faces, and said grooves each encircling one of said shafts proximal thereto.

10. A pump as defined in claim 9, wherein said bores are journalling bores in which said shafts are journalled for rotation; and wherein said passage means comprises passage portions formed in bearing surfaces which bound said bores, said passage portions extending over substantially the axial length of the respective bore and communicating with the respective compartments.

11. A fluid machine as defined in claim 1, wherein said rotatable member is the rotor of a vane pump and has a circumferential surface surrounding said axis and provided with circumferentially spaced radial slots; and further comprising a plurality of vanes, each slidably received in one of said slots.

12. A fluid machine as defined in claim 11, said vanes each having a radially outwardly directed contact face; and further comprising a contact ring surrounding said rotatable member and having an inner circumferential surface for engagement by said contact faces.

* * * * *